United States Patent [19]

Watanabe et al.

[11] Patent Number: 4,929,324

[45] Date of Patent: May 29, 1990

[54] APPARATUS FOR REMOVING ELECTROPLATING METAL DEPOSITED ONTO SURFACE OF CONDUCTOR ROLL

[75] Inventors: Tsutomu Watanabe; Masaru Sagiyama; Masaki Kawabe; Toshiyuki Tsujihara; Shigehiro Takushima, all of Tokyo, Japan

[73] Assignee: NKK Corporation, Tokyo, Japan

[21] Appl. No.: 392,972

[22] PCT Filed: Dec. 19, 1988

[86] PCT No.: PCT/JP88/01283

§ 371 Date: Aug. 14, 1989

§ 102(e) Date: Aug. 14, 1989

[87] PCT Pub. No.: WO89/05874

PCT Pub. Date: Jun. 29, 1989

[30] Foreign Application Priority Data

Dec. 18, 1987 [JP] Japan ..... 62-322316

[51] Int. Cl.[5] ..... C25D 17/00

[52] U.S. Cl. ..... 204/206

[58] Field of Search ..... 204/206

[56] References Cited

FOREIGN PATENT DOCUMENTS 54-21538 7/1979 Japan .

60-96798 5/1985 Japan .

*Primary Examiner*—T. M. Tufariello

*Attorney, Agent, or Firm*—Frishauf, Holtz, Goodman & Woodward

[57] ABSTRACT

An apparatus for removing, by means of a scraper, an electroplating metal deposited onto the surface of a conductor roll for electroplating. The above-mentioned removal is accomplished by pressing the scraper (23) arranged near the conductor roll (5) against the conductor roll (5). The start and the end of the removal can properly be controlled on the basis of a value of potential difference between a reference electrode (21) immersed in the electroplating solution and the conductor roll (5), as measured by means of a potentiometer (25). The scraper (23) return-travels, together with the reference electrode (21), in the axial direction of the conductor roll (5) by the action of a scraper moving mechanism (30).

1 Claim, 3 Drawing Sheets

APPARATUS FOR REMOVING ELECTROPLATING METAL DEPOSITED ONTO SURFACE OF CONDUCTOR ROLL

FIELD OF THE INVENTION

The present invention relates to an apparatus for removing an electroplating metal deposited onto the surface of a conductor roll in a horizontal type electroplating apparatus for a metal strip.

BACKGROUND OF THE INVENTION

A horizontal type electroplating apparatus has widely been applied for electrogalvanizing purposes because of the merits thereof such as a smaller loss of voltage and the necessity of a lower strength of a conductor roll and a supporting roll as compared with a vertical type electroplating apparatus. FIG. 4 is a schematic vertical sectional view illustrating a conventional horizontal type electroplating apparatus used for electrogalvanizing a steel strip. As shown in FIG. 4, a conventional horizontal type electroplating apparatus comprises a plurality of horizontal type electroplating tanks 2, arranged in series, for receiving an electroplating solution 3 and a plurality of pairs of upper and lower anode plates 4 arranged in parallel with a steel strip 1 to be electroplated, which horizontally travels in the electroplating tanks 2, with the steel strip 1 therebetween. For the purpose of preventing flapping or loosening of the steel strip 1 caused by the long travelling distance of the steel strip 1 through the electroplating tank 2, a plurality of pairs of supporting rolls 8 are provided in the electroplating tanks 2 so as to pinch the steel strip 1 therebetween.

Near each of the inlet and the outlet for the steel strip 1 of the electroplating tank 2, a conductor roll 5 and a backup roll 6 are provided the former above the latter outside the electroplating tank 2 with the steel strip 1 therebetween. The steel strip 1 is electrically negatively charged by the conductor roll 5. An electrogalvanizing layer is formed on the surface of the steel strip 1 by the electrode reaction in the electroplating solution 3. To prevent the electroplating solution 3 from flowing to outside the electroplating tank 2 along with the steel strip 1, and to keep a constant level of the electroplating solution 3 in the electroplating tank 2, a pair of dam rolls 7 are provided one above the other at each of the inlet end and the outlet end of the electroplating tank 2 with the steel strip 1 therebetween.

Such a horizontal type electroplating apparatus is large in scale in general, comprising sequentially from 10 to 15 electroplating tanks 2 each having a length of 6 m, a width of 2.5 m and a depth of 1.0 m, thus requiring a very high cost for heating the electroplating solution 3 in a large quantity supplied into the electroplating tanks 2. Furthermore, since there is a long distance (1 m, for example) between the conductor roll 5 and the anode plates 4, partly because of the arrangement of the dam rolls 7 therebetween, resistance of the steel strip 1 itself causes a considerable loss of voltage.

With a view to overcoming these inconveniences, therefore, it is the recent tendency to try to reduce the scale of the horizontal type electroplating apparatus by switching over from the soluble electrode to the non-soluble electrode or to reduce the distance between the conductor roll 5 and the anode plates 4 by eliminating the dam rolls 7.

In the case of a horizontal type electroplating apparatus without the dam rolls 7, a couple of the conductor roll 5 and the backup roll 6 are provided, instead of the pair of dam rolls 7, the former above the latter at each of the inlet end and the outlet end of the electroplating tank 2 with the steel strip 1 therebetween, and another couple of the conductor roll 5 and the backup roll 6 are provided also between the plurality of pairs of anode plates 4 in the electroplating tank 2. Since the lower portion of the conductor roll 5 is immersed in the electroplating solution 3, an electroplating metal is deposited onto the surface of the conductor roll 5 during electroplating. Deposition of the electroplating metal onto the surface of the conductor roll 5 results in an insufficient electrical contact between the conductor roll 5 and the steel strip 1, and partially hindered flow of electricity makes it impossible to achieve uniform electroplating. Furthermore, the electroplating metal deposited onto the surface of the conductor roll 5 is peeled off and falls down onto the steel strip 1, and as a result, the conductor roll 5 and the steel strip 1 bite the peeled electroplating metal therebetween. Consequently, flaws are produced on the surface of the steel strip 1, making the steel strip 1 a defective product. Such a defect in the product should absolutely be avoided. It is therefore necessary to prevent the electroplating metal from being deposited onto the surface of the conductor roll 5 or to remove the once deposited electroplating metal.

As a means to solve the above-mentioned problems, there is known an apparatus, as shown in FIG. 5, in which a scraper 9 for scraping off an electroplating metal deposited onto the surface of the conductor roll 5 is provided above the conductor roll 5, the lower portion of which is immersed in the electroplating solution 3 in the horizontal type electroplating tank 2. According to the above-mentioned conventional apparatus, it is possible to scrape off the electroplating metal deposited onto the surface of the rotating conductor roll 5 by pressing the scraper 9 against the conductor roll 5.

The above-mentioned conventional apparatus has however the following problem: While it is necessary to accurately determine the timing of the start and the end of the scraping by means of the scraper 9 of the electroplating metal deposited onto the surface of the conductor roll 5, this determination has conventionally been accomplished through visual inspection by an operator, and the deposition of the electroplating metal occurs non-uniformly in the axial direction of the conductor roll 5. It is therefore difficult to accurately determine the timing of the start and the end of the scraping of the deposited metal by means of the scraper 9. As a result, an early start of the scraping or a delayed end of the scraping of the deposited metal would result in grinding of the very surface of the conductor roll 5 not having an electroplating metal deposited thereon. This produces flaws on the surface of the conductor roll 5 and reduces the service life thereof. If there is a delayed start or an early end of the scraping of the deposited metal, on the other hand, the electroplating metal deposited onto the surface of the conductor roll 5 causes in the meantime an insufficient electrical contact between the conductor roll 5 and the steel strip 1, and the electroplating metal deposited onto the surface of the conductor roll 5 is peeled off and falls down onto the steel strip 1 and produces flaws on the surface of the steel strip 1.

Under such circumstances, there is a strong demand for the development of an apparatus for properly removing an electroplating metal deposited onto the surface of a conductor roll, the lower portion of which is immersed in an electroplating solution in a horizontal type electroplating tank, without producing any flaws on the surface of the conductor roll, but such an apparatus has not as yet been proposed.

SUMMARY OF THE INVENTION

An object of the present invention is therefore to provide an apparatus for properly removing an electroplating metal deposited onto the surface of a conductor roll, the lower portion of which is immersed in an electroplating solution in a horizontal type electroplating tank, without producing any flaws on the surface of the conductor roll.

In accordance with one of the features of the present invention, there is provided an apparatus for removing an electroplating metal deposited onto the surface of a conductor roll, comprising:

a scraper (23), provided above a conductor roll (5), the lower portion of which is immersed in an electroplating solution (3) in a horizontal type electroplating tank (2), for scraping off an electroplating metal deposited onto the surface of said conductor roll (5);

a reference electrode (21), at least the lower portion of which is immersed in said electroplating solution (3), provided near said conductor roll (5), the surface of said reference electrode (21), except for the portion facing said conductor roll (5), being electrically shielded by means of an insultating cover (22);

a scraper moving mechanism (30) for causing said scraper (23) to return-travel, together with said reference electrode (21), in the axial direction of said conductor roll (5);

a potentiometer (25) for continuously measuring a value of potential difference between said reference electrode (21) and said conductor roll (5); and an output converter (28) for controlling the start and the end of said scraping of said electroplating metal deposited onto the surface of said conductor roll (5) by means of said scraper (23), on the basis of said value of potential difference as measured by means of said potentiometer (25).

DETAILED DESCRIPTION OF PREFERRED EMBODIMENTS

Figure 1:
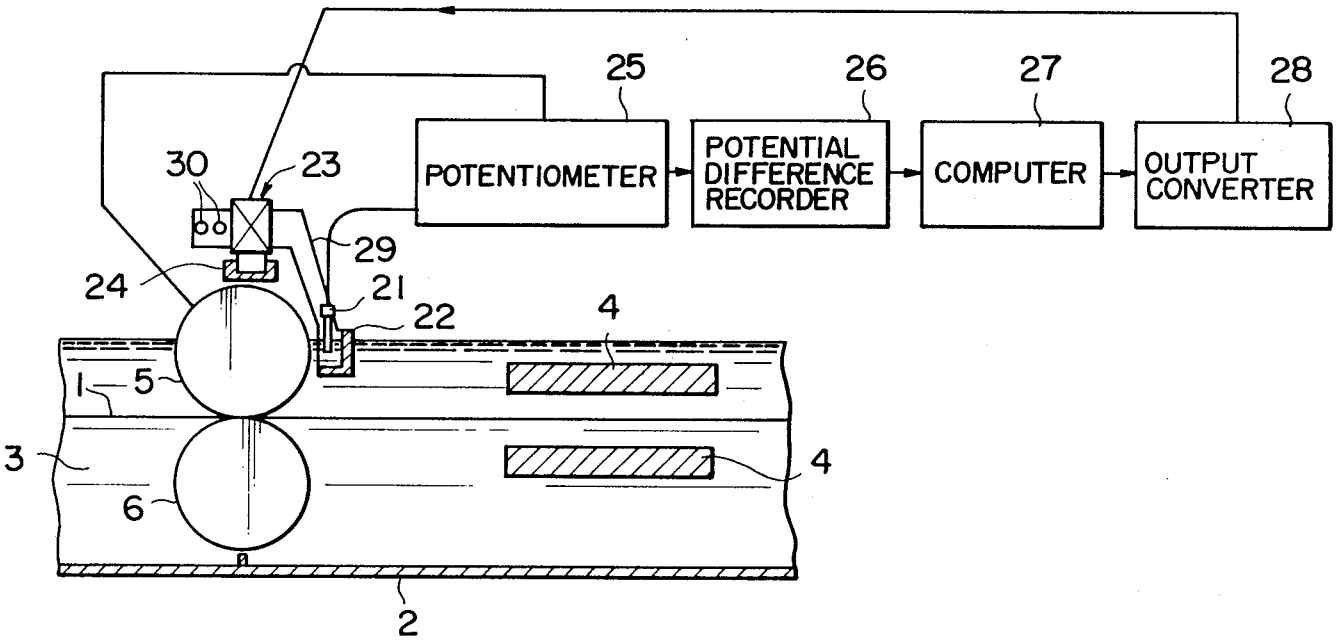
FIG. 1 is a schematic vertical sectional view illustrating an embodiment of the apparatus of the present invention for removing an electroplating metal deposited onto the surface of a conductor roll.
Figure 2:
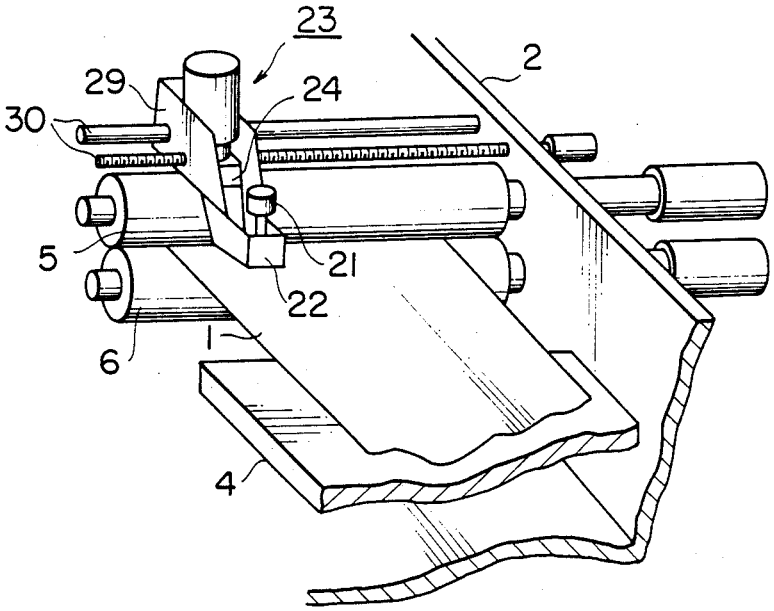
FIG. 2 is a partial perspective view illustrating the apparatus of the present invention shown in FIG. 1.

The apparatus of the present invention for removing an electroplating metal deposited onto the surface of a conductor roll comprises, as shown in FIGS. 1 and 2, a scraper 23, provided above a conductor roll 5, the lower portion of which is immersed in an electroplating solution 3 in a horizontal type electroplating tank 2, for scraping off an electroplating metal deposited onto the surface of the conductor roll 5, a reference electrode 21, at least the lower portion of which is immersed in the electroplating solution 3, provided near the conductor roll 5, a scraper moving mechanism 30, a potentiometer 25 for continuously measuring a value of potential difference between the reference electrode 21 and the conductor roll 5, and an output converter 28 for controlling the start and the end of the above-mentioned scraping by means of the scraper 23.

The scraper 23 is provided with an abrasive 24 for scraping off the electroplating metal deposited onto the surface of the conductor roll 5. The scraper 23 has a pressing mechanism for pressing the abrasive 24 against the surface of the conductor roll 5.

The surface of the reference electrode 21, except for the portion facing the conductor roll 5, is electrically shielded by means of an insulating cover 22 from the anode plates 4 and the steel strip 1.

Both the scraper 23 and the reference electrode 21 are fitted to a supporting member 29. Furthermore, the scraper moving mechanism 30, comprising a threaded rod and a guide bar, for return-moving the supporting member 29 in the axial direction of the conductor roll 5 is fitted to the supporting member 29. The scraper 23 return-travels along the guide bar, together with the reference electrode 21, through the supporting member 29, in the axial direction of the conductor roll 5, by rotating the threaded rod around the axial line thereof by means of a drive mechanism not shown.

A potential difference recorder 26 for continuously recording a potential difference, a computer 27 for detecting a point of sharp inflection of a potential difference, and the output converter 28 are connected in this order with conductors to the potentiometer 25 for continuously measuring a value of potential difference between the reference electrode 21 and the conductor roll 5.

The output converter 28 controls the start and the end of the scraping by means of the scraper 23 of the electroplating metal deposited onto the surface of the conductor roll 5, on the basis of the value of potential difference, as measured by means of the potentiometer 25 and communicated through the potential difference recorder 26 and the computer 27.

According to the above-mentioned apparatus of the present invention, an electroplating metal deposited onto the surface of the conductor roll 5 is removed as follows: A value of potential difference between the reference electrode 21 and the conductor roll 5 is continuously measured by means of the potentiometer 25. When the electroplating metal is not deposited onto the surface of the conductor roll 5, the above-mentioned value of potential difference as measured by means of the potentiometer 25 represents the potential of the conductor roll 5 itself. As the electroplating metal begins to be deposited onto the surface of the conductor roll 5, the abovementioned value of potential difference shifts toward the side of a precipitation potential of the electroplating metal, i.e., toward a base value. As the electroplating metal is deposited further, the above-mentioned value of potential difference sharply shifts toward a more base value to reach the precipitation potential of the electroplating metal, with no further change. This is detected by performing differentiation of the above-mentioned value of potential difference by means of the computer 27 to detect a point of sharp inflection.

The above-mentioned time point corresponds to the deposition of the electroplating metal over the entire circumferential zone of the conductor roll 5 at a certain measuring position. This change in the value of potential difference is continuously recorded in the potential difference recorder 26. It is therefore possible to know easily the time point when the electroplating metal is deposited over the entire circumferential zone of the conductor roll 5 at a certain measuring position.

When the deposition of the electroplating metal over the entire circumferential zone of the conductor roll 5 at a certain measuring position is detected as described above, a scraping start signal is sent from the output converter 28 to the scraper 23, and the scraper 23 presses the abrasive 24 against the surface of the conductor roll 5. Thus, the electroplating metal deposited onto the surface of the conductor roll 5 is scraped off by means of the abrasive 24. On the other hand, when the above-mentioned value of potential difference becoming equal to the potential of the conductor 5 itself is detected, a scraping end signal is sent from the output converter 28 to the scraper 23, and the scraper 23 withdraws the abrasive 24 thereof. The scraping of the electroplating metal deposited onto the conductor roll 5 by means of the abrasive 24 comes thus to an end. The potential of the conductor roll 5, which indicates the end of the scraping, may be set at a value somewhat more base than that of the potential of the conductor roll 5 itself, considering the scraping efficiency.

It is possible to scrape off the electroplating metal deposited onto the entire surface of the conductor roll 5 by causing the scraper 23 to return-travel, together with the reference electrode 21, in the axial direction of the conductor roll 5 by means of the scraper moving mechanism 30.

Now, the apparatus of the present invention is described more in detail by means of an example.

EXAMPLE

Using a horizontal type electroplating apparatus provided with the apparatus of the present invention for removing the electroplating metal deposited onto the surface of the conductor roll, as described above with reference to FIGS. 1 and 2, a steel strip was subjected to an electrogalvanizing treatment under the following conditions:

(1) Chemical composition of electrogalvanizing solution:

| | |
|---|---|
| Zinc sulfate | 400 g/l, |
| Sodium sulfate | 70 g/l, |
| Magnesium sulfate | 60 g/l. |

(2) Electrogalvanizing conditions:

| | |
|---|---|
| pH of plating solution | 1.5, |
| Temperature of plating solution | 50° C., |
| Electric current density of plating | |
| 100 A/dm$^2$, 70 A/dm$^2$, 60 A/dm$^2$, | |
| Plating time | 48 hours. |

(3) Travelling speed of steel strip: 120 m/minute.

During the above-mentioned electrogalvanizing, the scraper 23 was caused to return-travel, together with the reference electrode 21, in the axial direction of the conductor roll 5 by means of the scraper moving mechanism 30, to scrape off the electroplating zinc deposited onto the surface of the conductor roll 5. A roll made of an Fe-Cr-Ni alloy was used as the conductor roll 5, and an electrode made of silver and silver chloride was used as the reference electrode 21, and an abrasive cemented by a resin was used as the abrasive 24.

In the state in which the electroplating zinc was not deposited onto the surface of the conductor roll 5, the potential difference between the reference electrode 21 and the conductor roll 5, as measured by means of the potentiometer 25, showed a value of about −500 mV relative to the potential of the reference electrode 21. This value of potential difference gradually shifted toward a more base value with the lapse of the plating time. More particularly, the above-mentioned value of potential difference sharply shifted toward a more base value locally over the entire circumferential zone of the conductor roll 5 in the axial direction thereof to reach the precipitation potential of zinc five hours after the start of electrogalvanizing for the electric current density of 100 A/dm$^2$, ten hours after the atart of electrogalvanizing for the electric current density of 70 A/dm$^2$, and 20 hours after the start of electrogalvanizing for the electric current density of 60 A/dm$^2$, and the deposition of zinc over the entire circumferential zone of the conductor roll 5 was locally observed.

In this example, the scraping of the deposited zinc on the surface of the conductor roll 5 was therefore started by means of the scraper 23 at the moment when the above-mentioned potential difference took a value of −870 mV, and the above-mentioned scraping of the deposited zinc was discontinued at the moment when the above-mentioned potential difference took a value of −550 mV.

Figure 3:
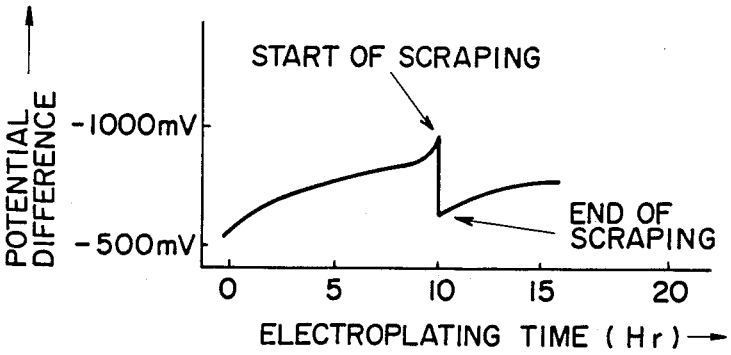
FIG. 3 is a graph illustrating changes in a value of potential difference between a reference electrode and a conductor roll during use of the apparatus of the present invention shown in FIG. 1.
Figure 4:
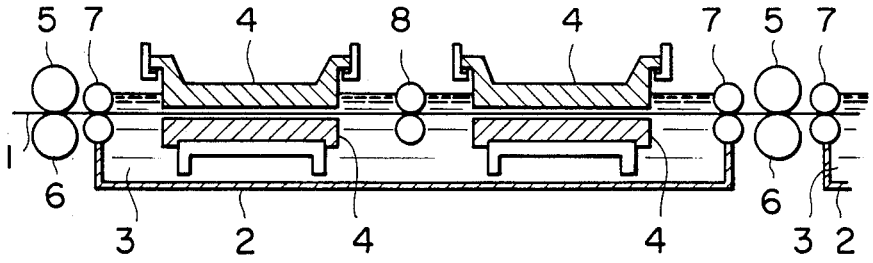
FIG. 4 is a schematic vertical sectional view illustrating a conventional horizontal type electroplating apparatus.
Figure 5:
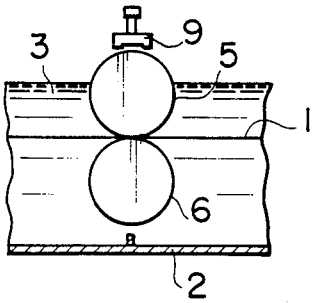
FIG. 5 is a schematic vertical sectional view illustrating a conventional apparatus for removing an electroplating metal deposited onto the surface of a conductor roll.

As a result, zinc deposited on the surface of the conductor roll 5 was properly scraped off without producing any flaws on the surface of the conductor roll 5. The scraped zinc exerted no adverse effect on the surface of the product. FIG. 3 is a graph illustrating changes in a value of potential difference between the reference electrode 21 and the conductor roll 5 in the case where electrogalvanizing is applied with an electric current density of 70 A/dm$^2$. In FIG. 3, the start and the end of the scraping of the deposited zinc are indicated with arrows.

The above-mentioned example has covered the case where electrogalvanizing is applied to the steel strip. However, the present invention is not limited to electrogalvanizing, but is applicable also for electroplating of any other metal.

According to the apparatus of the present invention, as described above in detail, it is possible to properly remove an electroplating metal deposited onto the surface of a conductor roll, the lower portion of which is immersed in an electroplating solution in a horizontal type electroplating tank without producing any flaws on the surface of the conductor roll, thus providing industrially useful effects.

What is claimed is:

1. An apparatus for removing an electroplating metal deposited onto the surface of a conductor roll, comprising:

a scraper (23), provided above a conductor roll (5), the lower portion of which is immersed in an electroplating solution (3) in a horizontal type electroplating tank (2), for scraping off an electroplating metal deposited onto the surface of said conductor roll (5);

a reference electrode (21), at least the lower portion of which is immersed in said electroplating solution (3), provided near said conductor roll (5), the surface of said reference electrode (21), except for the portion facing said conductor roll (5), being electrically shielded by means of an insulating cover (22);

a scraper moving mechanism (30) for causing said scraper (23) to return-travel, together with said reference electrode (21), in the axial direction of said conductor roll (5);

a potentiometer (25) for continuously measuring a value of potential difference between said reference electrode (21) and said conductor roll (5); and an output converter (28) for controlling the start and the end of said scraping of said electroplating metal deposited onto the surface of said conductor roll (5) by means of said scraper (23), on the basis of said value of potential difference as measured by means of said potentiometer (25).

* * * * *